US010926931B2

(12) United States Patent
Christopher

(10) Patent No.: US 10,926,931 B2
(45) **Date of Patent: *Feb. 23, 2021**

(54) DISPLAY PACKAGE FOR A HAND TOOL

(71) Applicant: Meridian International Co., Ltd., Shanghai (CN)

(72) Inventor: Brent Christopher, Centennial, CO (US)

(73) Assignee: Meridian International Co., Ltd., Shanghai (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/454,313

(22) Filed: Jun. 27, 2019

(65) Prior Publication Data

US 2019/0315542 A1 Oct. 17, 2019

Related U.S. Application Data

(63) Continuation of application No. 15/685,589, filed on Aug. 24, 2017, now Pat. No. 10,435,219.

(51) Int. Cl.

| | |
|---|---|
| ***B65D 73/00*** | (2006.01) |
| ***B25H 3/00*** | (2006.01) |
| *B25B 15/04* | (2006.01) |

(52) U.S. Cl.

CPC ..... *B65D 73/0014* (2013.01); *B25H 3/006* (2013.01); *B65D 73/0064* (2013.01); *B65D 73/0092* (2013.01); *B25B 15/04* (2013.01)

(58) Field of Classification Search

CPC ..... B65D 73/0014; B65D 73/0064; B65D 73/0071; B65D 73/0078; B65D 73/0085; B65D 73/0092; B25H 3/003; B25H 3/006; B25G 1/085; B25G 1/105; B25B 15/04

See application file for complete search history.

(56) References Cited

U.S. PATENT DOCUMENTS

| | | | |
|---|---|---|---|
| 1,177,072 | A | 3/1916 | Gossage |
| 1,675,171 | A | 6/1928 | Fegley |
| 1,681,107 | A | 8/1928 | Fegley |
| 4,450,961 | A | 5/1984 | Bies et al. |
| 4,586,615 | A | 5/1986 | Quitmann |
| 4,682,688 | A | 7/1987 | Budert |
| 4,899,877 | A | 2/1990 | Kiernan |
| 4,924,733 | A | 5/1990 | McKenzie |
| 5,174,178 | A | 12/1992 | Disston, Jr. |
| 5,190,154 | A | 3/1993 | Reusch |
| 5,279,417 | A | 1/1994 | Seaton |
| 5,477,964 | A | 12/1995 | Hart |
| 5,484,056 | A | 1/1996 | Wood |

(Continued)

FOREIGN PATENT DOCUMENTS

| | | |
|---|---|---|
| DE | 102007039978 | 10/2008 |
| EP | 1652789 | 5/2006 |

*Primary Examiner* — Patrick D Hawn

(74) *Attorney, Agent, or Firm* — Shuttleworth & Ingersoll, PLC; Jason R. Sytsma

(57) ABSTRACT

Packaging comprising of a display structure for displaying the hand tool. A retaining structure is combined to the display structure for engaging the working end of the ratchet tool with friction to prevent rotation of the working end. A securement structure is combined to the display structure and is configured to secure a portion of the ratchet tool in a manner that permits rotation of the handle of the ratchet tool relative to the working end while preventing the ratchet tool from being separated from the securement structure.

17 Claims, 3 Drawing Sheets

(56) References Cited

U.S. PATENT DOCUMENTS

| | | | |
|---|---|---|---|
| 5,501,330 | A | 3/1996 | Betts |
| D376,312 | S | 12/1996 | Cahn et al. |
| 5,606,897 | A | 3/1997 | Quinn |
| 5,740,706 | A | 4/1998 | Tseng |
| 5,743,395 | A | 4/1998 | Backer |
| 5,816,401 | A | 10/1998 | Vasudeva et al. |
| 5,899,329 | A | 5/1999 | Hu et al. |
| 5,918,741 | A | 7/1999 | Vasudeva |
| D420,577 | S | 2/2000 | Steel et al. |
| 6,079,298 | A | 6/2000 | Gasperi et al. |
| D429,461 | S | 8/2000 | Rowlay |
| D438,462 | S | 3/2001 | Nichol |
| 6,237,451 | B1 | 5/2001 | Wei |
| 6,241,092 | B1 | 6/2001 | Vasudeva |
| 6,283,311 | B1 | 9/2001 | Lee |
| 6,315,119 | B1 | 11/2001 | Lee |
| 6,425,482 | B1 | 7/2002 | Chiang |
| 6,457,916 | B2 | 10/2002 | Wienhold |
| 6,464,840 | B1 | 10/2002 | McCann |
| 6,561,523 | B1 | 5/2003 | Wienhold |
| 6,637,591 | B2 | 10/2003 | Chen |
| 6,685,018 | B1 | 2/2004 | Chuan |
| 6,834,767 | B1 | 12/2004 | Lin |
| 6,883,767 | B1 | 4/2005 | Huang |
| 6,907,990 | B2 | 6/2005 | Hu |
| 6,932,223 | B1 | 8/2005 | Lee et al. |
| 6,935,516 | B2 | 8/2005 | Chiang |
| 7,100,777 | B1 | 9/2006 | Kao |
| 7,210,663 | B2 | 5/2007 | Wheeler et al. |
| D644,901 | S | 9/2011 | Christopher |
| D645,733 | S | 9/2011 | Christopher |
| 8,079,469 | B2 | 12/2011 | Gui |
| 8,157,092 | B2 | 4/2012 | Christopher |
| D668,139 | S | 10/2012 | Yang et al. |
| D672,957 | S | 12/2012 | Christopher |
| 9,550,615 | B2 | 1/2017 | Miller |
| 2002/0020537 | A1 | 2/2002 | Shonfeld et al. |
| 2002/0027092 | A1 | 3/2002 | Hu |
| 2002/0175257 | A1 | 11/2002 | Yen |
| 2004/0094444 | A1 | 5/2004 | Chen |
| 2004/0251153 | A1 | 12/2004 | Chen |
| 2004/0256262 | A1 | 12/2004 | Wheeler et al. |
| 2005/0066779 | A1 | 3/2005 | Huang |
| 2005/0189250 | A1 | 9/2005 | Hsu |
| 2005/0247587 | A1 | 11/2005 | Holland-Letz |
| 2006/0260964 | A1 | 11/2006 | Feldmann et al. |
| 2007/0023307 | A1 | 2/2007 | Liu |
| 2007/0095690 | A1 | 5/2007 | Nguy et al. |
| 2007/0102382 | A1 | 5/2007 | Tuan Mu |
| 2007/0163906 | A1 | 7/2007 | Crain et al. |
| 2007/0228240 | A1 | 10/2007 | Kao |
| 2008/0110302 | A1 | 5/2008 | Liu |
| 2009/0236250 | A1 | 9/2009 | Wang |
| 2009/0242443 | A1 | 10/2009 | Chen |
| 2010/0108552 | A1 | 5/2010 | Schrimshaw et al. |
| 2011/0209584 | A1 | 9/2011 | Suter |
| 2011/0297568 | A1 | 12/2011 | Miller |
| 2012/0043239 | A1 | 2/2012 | Kriz et al. |

DISPLAY PACKAGE FOR A HAND TOOL

CROSS-REFERENCE TO RELATED APPLICATIONS

The present application is a continuation of U.S. patent application Ser. No. 15/685,589 filed Aug. 24, 2017, the contents of which are incorporated herein by reference.

TECHNICAL FIELD

This invention relates to a case for displaying hand tools at a point of sale, and particularly a case that allows a customer to test the hand tool without removing the hand tool from the case.

BACKGROUND INFORMATION

Tool sets are customarily sold in cases with multiple interchangeably driven bits. The cases are sealed at the point of sale to prevent the ratchet tool and/or the driven bits from being lost or stolen. Consequently, it is not possible for the customer to test the ratchet tool without opening the case and breaking the seal.

There are examples of articles and tools be mounted to packaging in a manner that allows the user to manipulate the article or test the function of the ratchet tool. This degree of functionality and access to the product before it is purchased is desirable because it allows the consumer to test the article or ratchet tool before purchase. This enhanced experience may increase the likelihood that the consumer will purchase the product. The present application relates to a unique packaging arrangement that permits the consumer to test a function of the ratchet tool before it is purchased.

SUMMARY

Disclosed is a packaging for a hand tool having a handle and a working end. The hand tool can be a ratchetting hand tool or a fixed hand tool. For a ratcheting hand tool, the packaging comprises of a display structure for displaying the ratchet tool. A retaining structure is combined to the display structure for engaging the working end of the ratchet tool with friction to prevent rotation of the working end. A securement structure is combined to the display structure and is configured to secure a portion of the ratchet tool in a manner that permits rotation of the handle of the ratchet tool relative to the working end while preventing the ratchet tool from being separated from the securement structure.

The retaining structure can further comprise at least one cradle for receiving the working end and a snap clip that fits over and attaches to the cradle to secure with friction the working end of the ratchet tool to prevent rotation of the working end. A flexible finger is combined thereto and a friction pad on the flexible finger engages the ratchet tool to assist with holding the working end of the ratchet tool in position while the handle of the ratchet tool is rotated. In an embodiment, the retaining structure can comprise a first cradle and a second cradle for receiving the working end and a first snap clip that fits over the working end and attaches to the first cradle and a second snap clip that fits over the working end and attaches to the second cradle to secure with friction the working end of the ratchet tool to prevent rotation of the working end. The working end can further comprise a ratchet portion and a ratchet extension that is selectively separable from the ratchet portion. The second cradle can further comprise a stop to prevent the ratchet extension from being separated from the ratchet portion and limits axial movement of the ratchet extension.

In an embodiment, the ratchet tool can further comprise of a groove and wherein the securement structure can further comprise of a housing and a mechanical lock that engages the groove of the ratchet tool and fixedly attaches to the housing to secure the ratchet tool to the securement structure. The groove can be an annular groove that circumscribes the ratchet tool. The mechanical lock can be a snap ring with an inner diameter that fits into the annular groove. A plurality of snap-members can be combined to the snap ring to engage an inner diameter of the housing of the securement structure to secure the ratchet tool to the securement structure.

In an embodiment, the ratchet tool can further comprise a directional switch. The annular groove can be positioned between the handle and the directional switch to allow a consumer to grip the handle of the ratchet tool to test a ratcheting function of the ratchet tool.

In an embodiment, the display structure further comprises of a first portion and a second portion with the securement structure positioned between the first portion and the second portion of the display structure. The first portion can comprise of a plurality of cutouts through which portions of the securement structure can extend through. The first portion and the second portion of the display structure can be secured together to fix the securement structure in position. The display structure can be folded in half wherein one half of the display structure is the first portion and the other half of the display structure is the second portion. Alternatively, the first portion and the second portion can be glued together to fix the securement structure in position.

DETAILED DESCRIPTION

Figure 1:
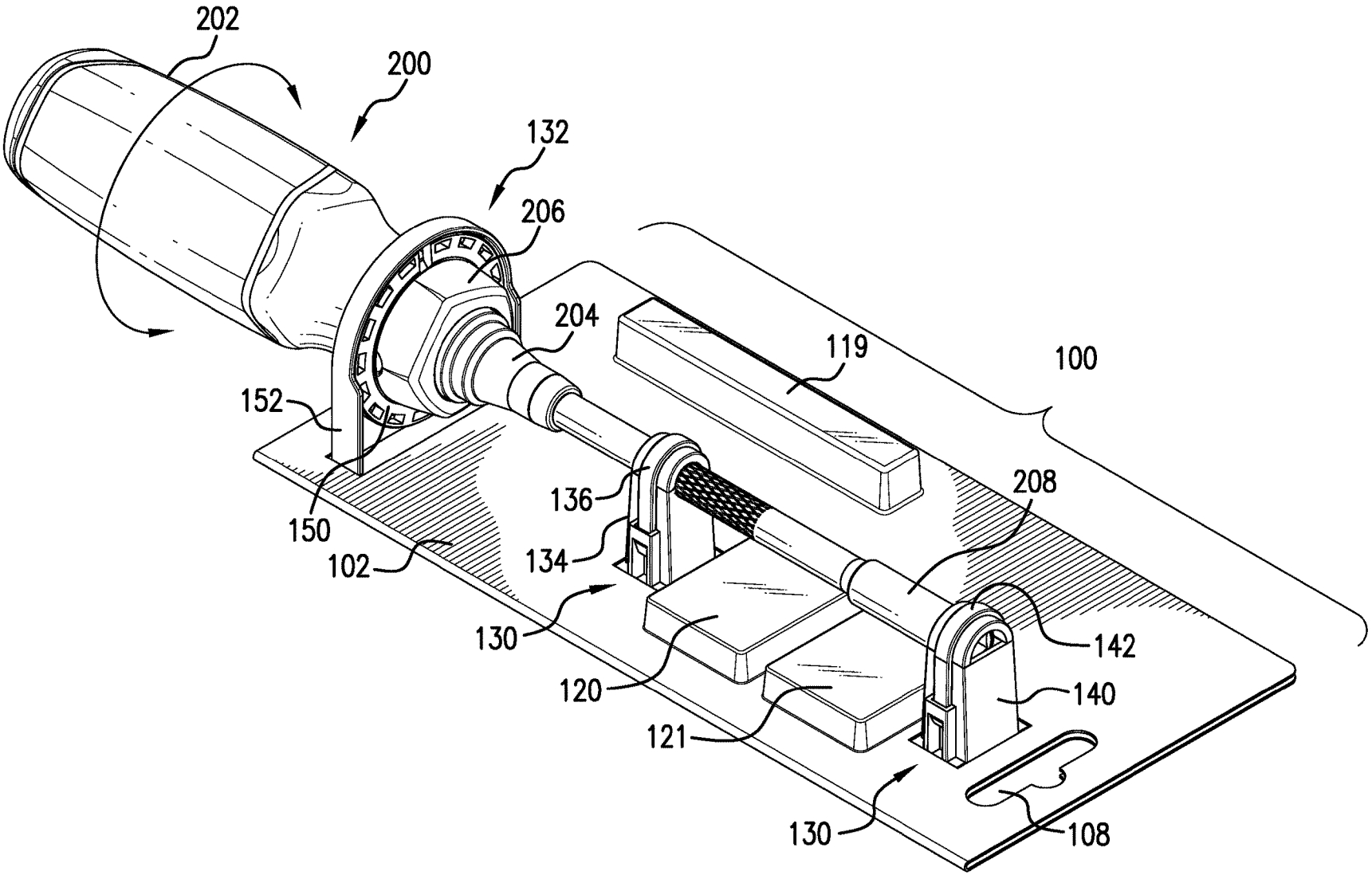
FIG. 1 is a perspective view of a packaging for a hand tool.

FIG. 1 shows an illustrated embodiment of a packaging 100 for a ratchet tool 200 according to an embodiment of this disclosure. Ratchet tool 200 may be of any type, but the instant disclosure is directed to a ratchet tool 200 with a handle 202 combined to a ratchet 204 by an internal set of pawls and gears that permits one-way rotation of handle 202 with respect to ratchet 204. Ratchet tool 200 can have a directional switch 206 that can be manipulated by a user to select the ratcheting direction (i.e., clockwise or counter clockwise). Ratchet tool 200 can also have a ratchet extension 208 to increase a length of ratchet 202. Ratchet portion 204 and ratchet extension 208 are separate pieces but when combined for a single working end 210 for ratchet tool 200.

The instant disclosure is directed to packaging 100 for ratchet tool 200 to display ratchet tool 200 at a point of sale and allow a potential customer to manipulate handle 202 of ratchet tool 200 to test the ratcheting function of ratchet tool 200.

Figure 2:
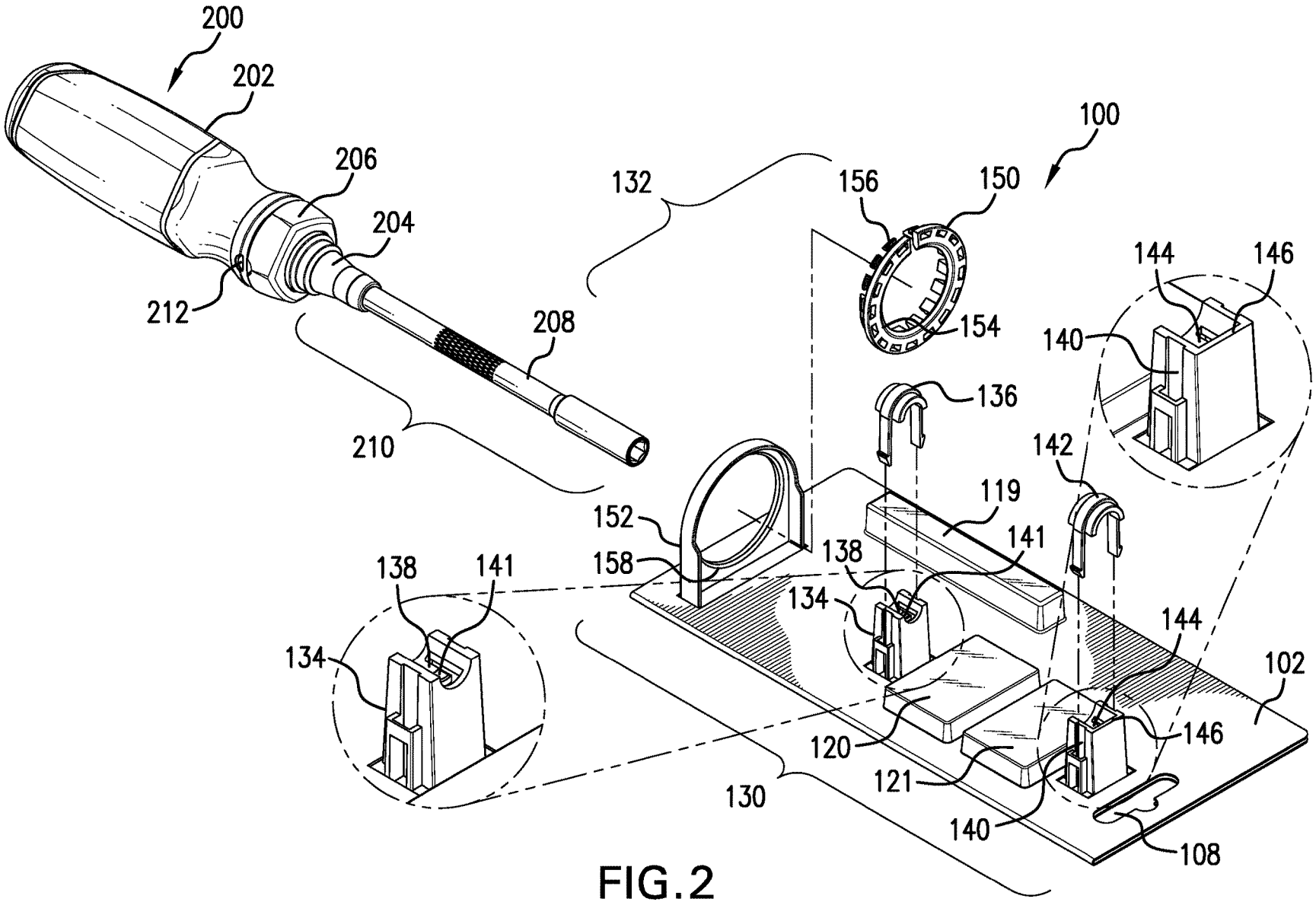
FIG. 2 is an exploded, perspective view of the packaging for the hand tool of FIG. 1.

FIG. 2 shows an exploded view of packaging 100. Packaging 100 includes a display structure 102 that can be sized and shaped to display useful information about ratchet tool 200. Such useful information may include, for example, branding information, directions on use, price and sales information, warnings, etc. Display structure 102 may be of any suitable construction such as paper, plastic, or a combination of the two.

Figure 3:
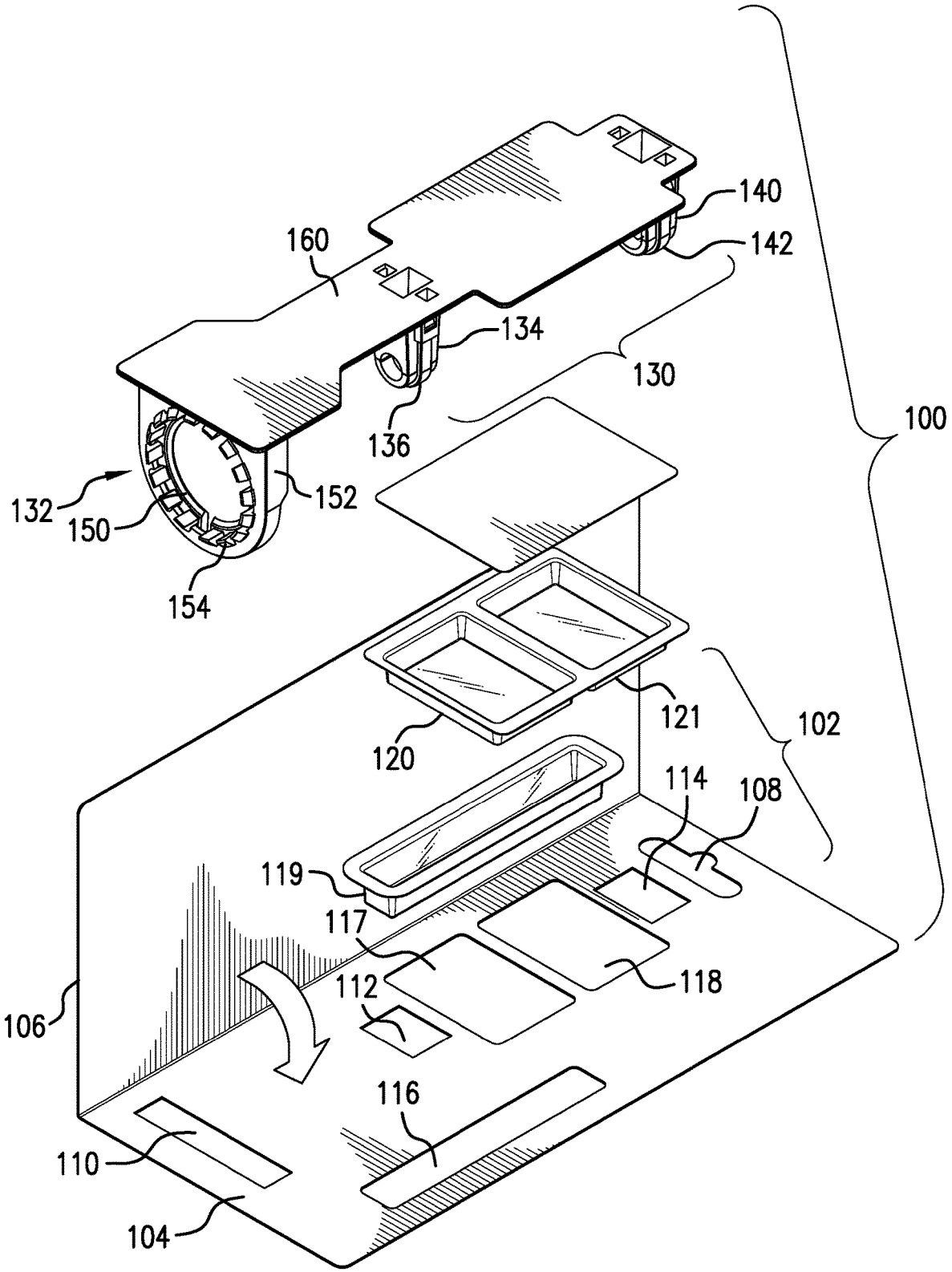
FIG. 3 is a perspective view of the packaging for the hand tool of FIG. 1 with the packaging disassembled.

In an embodiment, display structure 102 is configured a first portion 104 and a second portion 106, as shown in FIG. 3. First portion 104 and second portion 106 can be secured together to fix other portions of packaging 100 in position. This securement can be done in a number of different ways. Display structure 102 can be made of a single piece of material (paper or plastic) folded in half wherein one half of display structure 102 is first portion 104 and the other half of display structure 102 is second portion 106. The two halves can then be fixed together with glue, staples, an attachment, etc. Alternatively, display structure 102 can be made of at least two pieces of material wherein first portion 104 and second portion 106 are attached together with glue, staples, an attachment, etc.

Display structure 102 may be configured for hanging on a rack at a point of sale. In this case, display structure 102 can have a hanger cutout 108 that allows packaging 100 to hang perpendicularly at the point of sale. The information printed on display structure 102 can be printed in such a manner across the display structure 102 accommodate this arrangement. Display structure 102 can have a number of other cutouts, some of which, for example cutout 110, cutout 112, and cutout 114 are used for providing an escape to portions of a retaining structure 130 and a securement structure 132, which are used to connect ratchet tool 200 to packaging 100. Other cutouts, for example, one or more of cutout 116, 117, and 118 can be added for a container, 119, 120, and 121, respectively, used for holding extra bits or attachments for ratchet tool 200.

Packaging 100 also includes a retaining structure 130 combined to display structure 102 for engaging working end 210 of ratchet tool 200 with friction to prevent rotation of working end 210. Retaining structure 130 can comprise at least one cradle (referred to herein after as a first cradle 134) for receiving working end 210 and a first snap clip 136 that fits over and attaches to cradle 134 to secure with friction working end 210 of ratchet tool 200 to prevent rotation of working end 210 when handle 202 of ratchet tool 200 is rotated.

First cradle 134 can further comprise a flexible finger 138 combined to first cradle 134 in manner that provides flexible finger 138 with some resilience that causes it to flex. At an end of flexible finger 138 is a friction pad 141 to engage working end 210 to assist with holding working end 210 in position while handle 202 of ratchet tool 200 is rotated.

In the illustrated embodiment, retaining structure 130 further comprise of a second cradle 140 for receiving working end 210. Like first cradle 134, second cradle 140 receives working end 210. Also provided is a second snap clip 142 that fits over and attaches to second cradle 140 to secure with friction working end 210 of ratchet tool 200 to prevent rotation of working end 210 when handle 202 of ratchet tool 200 is rotated. Second cradle 140 also comprise a flexible finger 144 combined to second cradle 140 in manner that provides flexible finger 144 with some resilience that causes it to flex. At an end of flexible finger 144 is a friction pad to engage working end 210 to assist with holding working end 210 in position while handle 202 of ratchet tool 200 is rotated.

Second cradle 140 can also comprise a stop 146 to prevent ratchet extension 208 from being separated from ratchet portion 204 and limit the axial movement of ratchet extension 208. Stop 146 prevents ratchet extension 208 from being separated from ratchet portion 204 at the point of sale. Stop 146 can be made of any material or simply made integral with second cradle 140 as a piece of material that gives another side on second cradle 140.

Packaging 100 also comprises securement structure 132 combined to display structure 102 and configured to secure a portion of ratchet tool 200 in a manner that permits rotation of handle 202 of ratchet tool 200 relative to working end 210 while preventing ratchet tool 200 from being separated from securement structure 132.

Ratchet tool 200 can have a grove 212 on directional switch 206 to which securement structure 132 engaged. In such an embodiment, securement structure can include a mechanical lock 150 that engages groove 212 and a housing 152 to which mechanical lock 150 attaches. This arrangement fixes ratchet tool 200 to securement structure 132 at the point of sale. Groove 212 can be an annular groove that circumscribes ratchet tool 200. The annular groove can be between handle 202 and directional switch 206 to provide a space of separation so that switch can rotate to allow a consumer to grip handle 202 of ratchet tool 200 to test a ratcheting function of ratchet tool 200. Mechanical lock 150 can be a snap ring with an inner diameter 154 that fits into groove 212 of directional switch 206. A plurality of snap-members 156 combined to mechanical lock 150 can engage an inner diameter 158 of housing 152 of to secure ratchet tool 200 to securement structure 132. In such a configuration, ratchet tool 200 can be inserted through inner diameter 158 of the housing 152.

Retaining structure 130 and securement structure 132 can be combined together on a plate 160, which is shown in FIG. 3. Plate 160 can be generally flat of uniform thickness between retaining structure 130 and securement structure 132. This allows plate 160 to fit between first portion 104 and second portion 106 of display structure 102. As shown in FIGS. 1 and 2, once first portion 104 is place over top plate 160 on top of second portion 106 of display structure 102, retaining portion 130 and securement portion 132 project through cutout 112, 114 and cutout 110 in first portion 104, respectively. Then, first portion 104 is secured to second portion 106 in the manner described above, which secures retaining portion 130 and securement portion 132 to display structure 102. Plate 160 can be a single piece of material with mechanical lock 150, first snap clip 136 and second snap clip 142 attaching thereto. Or, plate 160 can comprise multiple components fitted together.

FIG. 2 shows how ratchet tool 200 can be attached to packaging 100. Working end 210 of ratchet tool 200 can be extended through housing 152 of securement structure 132 and placed on first cradle 134 and second cradle 140 of retaining structure 130. Corresponding first snap clip 136 and second snap clip 142 are attached to their respective first cradle 134 and second cradle 140 to secure with friction working end 210 of ratchet tool. Mechanical lock 150 is attached to ratchet tool 200 and to housing 152 to secure ratchet tool 200 to securement structure 132. This completes the combination of ratchet tool 200 to packaging 100.

The foregoing arrangement allows a potential customer to test the function of ratchet tool 200 at the point of sale. The potential customer can manipulate handle 202 in either the clockwise or counter clockwise direction and listen to the ratcheting sound of handle 202 rotating with respect to working end 210 of ratchet tool 200. It is believed that by providing the potential customer with the ability to test the function of ratchet tool 200, the potential customer is more likely to purchase ratchet tool 200.

It should also be understood that ratchet tool 200 can be replaced with a non-ratcheting hand tool when it is still desirable to give the potential customer an opportunity to test the feel of the hand tool.

The Various aspects of any of the embodiments can be combined in different combinations than the ones shown to create new embodiments that fall within the scope of the appended claims.

While the present invention has been particularly shown and described with reference to exemplary embodiments thereof, it should be understood by those of ordinary skill in the art that various changes, substitutions and alterations can be made herein without departing from the scope of the invention as defined by appended claims and their equivalents. The invention can be better understood by reference to the following claims. For purpose of claim interpretation, the transitional phrases "including" and "having" are intended to be synonymous with the transitional phrase "comprising."

What is claimed is:

1. Packaging for a ratchet tool having a handle and a working end comprising:

a display structure for displaying the ratchet tool;

a retaining structure combined to the display structure comprising at least one cradle for receiving and surrounding the working end and for touchingly engaging the working end of the ratchet tool to prevent rotation of the working end; and a securement structure combined to the display structure and configured to secure a portion of the ratchet tool in a manner that permits rotation of the handle of the ratchet tool relative to the working end while preventing the ratchet tool from being separated from the securement structure, wherein the surrounding structure of the retaining structure is a snap clip that is selectively removable from the retaining structure and fits over and attaches to the cradle to secure the working end of the ratchet tool to prevent rotation of the working end.

2. The packaging of claim 1, wherein the at least one cradle further comprises of a friction pad on the retaining structure to provide friction to engage the working end of the ratchet tool to prevent rotation of the working end.

3. The packaging of claim 1, wherein the retaining structure further comprises a first cradle and a second cradle for receiving the working end and a first snap clip that fits over the working end and attaches to the first cradle and a second snap clip that fits over the working end and attaches to the second cradle to secure with friction the working end of the ratchet tool to prevent rotation of the working end.

4. The packaging of claim 1, wherein the working end further comprises a ratchet portion and a ratchet extension that is selectively separable from the ratchet portion and the second cradle furthercomprises a stop to prevent the ratchet extension from being separated from the ratchet portion and limits axial movement of the ratchet extension.

5. The packaging of claim 1, wherein the ratchet tool further comprises of a groove and wherein the securement structure further comprises of a housing and a mechanical lock that engages the groove of the ratchet tool and fixedly attaches to the housing to secure the ratchet tool to the securement structure.

6. The packaging of claim 5, wherein the groove is an annular groove that circumscribes the ratchet tool and the mechanical lock is a snap ring with an inner diameter that fits into the annular groove and a plurality of snap-members combined to the snap ring that engage an inner diameter of the housing of the securement structure to secure the ratchet tool to the securement structure.

7. The packaging of claim 6 wherein the ratchet tool can be inserted through the inner diameter of the housing.

8. The packaging of claim 7, wherein the ratchet tool further comprises a directional switch, and wherein the annular groove is positioned on the directional switch to allow a consumer to grip the handle of the ratchet tool to test a ratcheting function of the ratchet tool.

9. The packaging of claim 1, wherein the display structure further comprises of a first portion and a second portion with the securement structure positioned between the first portion and the second portion of the display structure.

10. The packaging of claim 9, wherein the first portion comprises of a plurality of cutouts through which portions of the securement structure can extend through.

11. The packaging of claim 10, wherein the first portion and the second portion of the display structure are secured together to fix the securement structure in position.

12. The packaging of claim 11, wherein the display structure is folded in half wherein one half of the display structure is the first portion and the other half of the display structure is the second portion.

13. The packaging of claim 12, wherein the first portion and the second portion are glued together to fix the securement structure in position.

14. A ratchet tool and packaging comprising:

a ratchet tool comprising a handle and a working end;

a display structure for displaying the ratchet tool;

a retaining structure combined to the display structure for surrounding and engaging an outer diameter of the working end of the ratchet tool to prevent rotation of the working end; and a securement structure combined to the display structure and configured to secure a portion of the ratchet tool in a manner that permits rotation of the handle of the ratchet tool relative to the working end while preventing the ratchet tool from being separated from the securement structure, wherein the retaining structure further comprises the first cradle and a second cradle for receiving the working end and wherein the surrounding structure is a first snap clip that fits over the working end and attaches to the first cradle and a second snap clip that fits over the working end and attaches to the second cradle to secure with friction the working end of the ratchet tool to prevent rotation of the working end; wherein the working end of the ratchet tool further comprises a ratchet portion and a ratchet extension that is selectively separable from the ratchet portion; and wherein the second cradle further comprises a stop to prevent the ratchet extension from being separated from the ratchet portion and limits axial movement of the ratchet extension.

15. A ratchet tool and packaging comprising:

a ratchet tool comprising a handle and a working end;

a display structure for displaying the ratchet tool;

a retaining structure combined to the display structure for surrounding and engaging an outer diameter of the working end of the ratchet tool to prevent rotation of the working end; and a securement structure combined to the display structure and configured to secure a portion of the ratchet tool in a manner that permits rotation of the handle of the ratchet tool relative to the working end while preventing the ratchet tool from being separated from the securement structure, wherein the ratchet tool further comprises of a groove and wherein the securement structure further comprises of a housing and a mechanical lock that engages the groove of the ratchet tool and fixedly attaches to the housing to secure the ratchet tool to the securement structure; wherein the groove is an annular groove that circumscribes the ratchet tool and the mechanical lock is a snap ring with an inner diameter that fits into the annular groove and a plurality of snap-members combined to the snap ring that engage an inner diameter of the housing of the securement structure to secure the ratchet tool to the securement structure; wherein the ratchet tool can be inserted through the inner diameter of the housing; and wherein the ratchet tool further comprises a directional switch, and wherein the annular groove is positioned on the directional switch to allow a consumer to grip the handle of the ratchet tool to test a ratcheting function of the ratchet tool.

16. A hand tool and packaging comprising:

a hand tool comprising a handle and a working end;

a display structure for displaying the hand tool;

a retaining structure combined to the display structure for engaging the working end of the hand tool so that the hand tool cannot be separated from the packaging; wherein the retaining structure further comprises a first cradle for receiving the working end and a first snap clip that fits over the working end and attaches to the first cradle to secure the working end of the hand tool to prevent the hand tool from being separated from the packaging; and a securement structure combined to the display structure and configured to secure a portion of the hand tool in a manner that permits rotation of the handle tool while preventing the hand tool from being separated from the securement structure.

17. The hand tool and packaging of claim 16, wherein the hand tool further comprises of a groove and wherein the securement structure further comprises of a housing and a mechanical lock that engages the groove of the hand tool and fixedly attaches to the housing to secure the hand tool to the securement structure; wherein the groove is an annular groove that circumscribes the hand tool and the mechanical lock is a snap ring with an inner diameter that fits into the annular groove and a plurality of snap-members combined to the snap ring that engage an inner diameter of the housing of the securement structure to secure the hand tool to the securement structure; and wherein the hand tool can be inserted through the inner diameter of the housing.

* * * * *